US010364053B2

(12) United States Patent
Wensley et al.

(10) Patent No.: US 10,364,053 B2
(45) Date of Patent: Jul. 30, 2019

(54) VIAL PREPARATION METHOD AND SYSTEM

(75) Inventors: Emma J. Wensley, Evanston, IL (US); Andrew Malcolm Knill, Victoria (AU); John Frederic Suendermann, Victoria (AU)

(73) Assignee: Hospira Australia Pty Ltd, Victoria (AU)

( * ) Notice: Subject to any disclaimer, the term of this patent is extended or adjusted under 35 U.S.C. 154(b) by 978 days.

(21) Appl. No.: 13/814,719

(22) PCT Filed: Aug. 5, 2011

(86) PCT No.: PCT/AU2011/001013

§ 371 (c)(1),
(2), (4) Date: Apr. 18, 2013

(87) PCT Pub. No.: WO2012/016301

PCT Pub. Date: Feb. 9, 2012

(65) Prior Publication Data

US 2013/0205719 A1 Aug. 15, 2013

Related U.S. Application Data

(60) Provisional application No. 61/434,928, filed on Jan. 21, 2011, provisional application No. 61/371,318, filed on Aug. 6, 2010.

(51) Int. Cl.
*B65B 7/00* (2006.01)
*B01L 3/00* (2006.01)
(Continued)

(52) U.S. Cl.
CPC ..... *B65B 7/00* (2013.01); *B01L 3/5082* (2013.01); *B65B 3/003* (2013.01); *B65B 7/2821* (2013.01);
(Continued)

(58) Field of Classification Search
CPC ..... B65B 3/003; B65B 7/00; B65B 31/027; B65B 7/2821; B65B 31/00; B65D 39/0023; B65D 81/2076; F26B 5/06; B01L 3/5082
See application file for complete search history.

(56) References Cited

U.S. PATENT DOCUMENTS 3,025,991 A * 3/1962 Gillon ..... B65D 51/241 215/311
3,146,077 A * 8/1964 Fuentevilla ..... F26B 5/06 165/80.5
(Continued)

FOREIGN PATENT DOCUMENTS

AU 2006319012 A1 6/2007
CN 1902320 A 1/2007
(Continued)

OTHER PUBLICATIONS

International Search Report and Written Opinion for PCT/AU2011/001013, dated Nov. 7, 2011.
(Continued)

*Primary Examiner* — Alexander M Valvis
*Assistant Examiner* — Lucas E. A. Palmer
(74) *Attorney, Agent, or Firm* — Jason G. Tebbutt

(57) ABSTRACT

Embodiments generally relate to vial preparation methods and to vials prepared by such methods. Some embodiments relate to use of an apparatus, such as a lyophilization apparatus, to perform the methods. An illustrative vial preparation method comprises:

housing a plurality of vials in a temperature-controlled environment, wherein the plurality of vials each have a volume of a substance therein and each defines an unfilled volume therein, each vial having a stopper partially inserted into an opening of the vial so that gas can transfer between the unfilled volume and an external volume;

(Continued)

applying a vacuum to the environment to reduce pressure in the environment and in the unfilled volume of each vial to a first pressure level;

venting an inert gas into the environment to raise the pressure in the environment and in the unfilled volume of each vial to a second pressure level;

allowing the vials to rest in the environment at the second pressure level for a predetermined period;

repeating the applying, venting and allowing at least once; and fully inserting the stopper into each opening to seal each vial after the repeating.

23 Claims, 5 Drawing Sheets

(51) Int. Cl.

| | |
|---|---|
| ***B65B 3/00*** | (2006.01) |
| ***B65B 31/02*** | (2006.01) |
| ***F26B 5/06*** | (2006.01) |
| ***B65B 7/28*** | (2006.01) |
| ***B65D 39/00*** | (2006.01) |
| ***B65D 81/20*** | (2006.01) |

(52) U.S. Cl.
CPC ..... *B65B 31/027* (2013.01); *B65D 39/0023* (2013.01); *B65D 81/2076* (2013.01); *F26B 5/06* (2013.01)

(56) References Cited

U.S. PATENT DOCUMENTS 3,292,342 A * 12/1966 Kapeker ..... B65B 31/027 53/101
3,537,233 A * 11/1970 Wiegmann ..... B65B 31/027 29/527.7
3,668,819 A * 6/1972 Henshaw ..... F26B 5/044 53/102
RE28,085 E * 7/1974 Costello et al. ..... B30B 7/02 29/527.7
3,996,725 A * 12/1976 Walles ..... B65B 31/027 53/101
4,142,303 A * 3/1979 Fraser ..... F26B 5/06 34/92
4,161,857 A * 7/1979 Fraser ..... B65B 31/027 53/101
4,236,633 A * 12/1980 Ernerot ..... A61K 9/0019 206/213.1
4,286,389 A * 9/1981 Ogle ..... F26B 5/06 215/307
5,398,426 A * 3/1995 Connor ..... F26B 5/06 34/289
5,597,530 A * 1/1997 Smith ..... A61L 2/07 134/150
5,788,670 A * 8/1998 Reinhard ..... A61M 5/3129 604/191
6,258,078 B1 * 7/2001 Thilly ..... A61J 1/2096 206/363
6,564,471 B1 * 5/2003 Sutherland ..... F26B 5/06 34/284
8,070,739 B2 * 12/2011 Zinger ..... A61J 1/2089 604/411
8,950,609 B2 * 2/2015 Aneas ..... A61J 1/1412 215/247
8,952,065 B2 * 2/2015 Pavliv ..... A61K 31/197 514/562
2002/0010164 A1 1/2002 Abrahamson et al.
2003/0100866 A1 * 5/2003 Reynolds ..... A61J 1/062 604/187
2005/0178462 A1 * 8/2005 Py ..... A61J 1/1412 141/2
2005/0194059 A1 * 9/2005 Py ..... B65B 3/003 141/18
2005/0223677 A1 * 10/2005 Py ..... B65B 3/003 53/140
2005/0281737 A1 * 12/2005 Kuperus ..... A61K 51/10 424/1.11
2006/0048844 A1 * 3/2006 Merrill ..... A61L 9/00 141/85
2006/0178644 A1 * 8/2006 Reynolds ..... A61J 1/2093 604/232
2007/0003488 A1 * 1/2007 Wright ..... A61B 17/00008 424/47
2007/0049640 A1 * 3/2007 Pavliv ..... A61K 9/0019 514/562
2007/0062162 A1 * 3/2007 Lehmann ..... B65B 31/025 53/432
2007/0125442 A1 * 6/2007 Tribble ..... B65B 3/003 141/27
2009/0001042 A1 * 1/2009 Sever ..... B65D 41/28 215/248
2009/0274762 A1 * 11/2009 Willis ..... A61K 9/0019 424/486
2010/0050575 A1 * 3/2010 Aneas ..... B65D 41/28 53/485
2010/0180551 A1 * 7/2010 Duethorn ..... B65B 7/2821 53/467
2010/0224632 A1 * 9/2010 Aneas ..... B65D 51/002 220/315
2011/0005622 A1 * 1/2011 Boeckeler ..... A61J 1/1406 137/581
2011/0094188 A1 * 4/2011 Bottger ..... A61J 1/2093 53/425
2011/0094189 A1 * 4/2011 Bottger ..... B65B 3/003 53/425
2011/0265430 A1 * 11/2011 Ulm ..... B65B 5/103 53/490
2011/0271642 A1 * 11/2011 Monti ..... B67B 1/04 53/319
2011/0289951 A1 * 12/2011 Furlong ..... F28B 1/06 62/171
2011/0302883 A1 * 12/2011 Monti ..... B65B 3/003 53/281
2011/0302884 A1 * 12/2011 Monti ..... B65B 3/003 53/281
2012/0152791 A1 * 6/2012 Brahmbhatt ..... B65B 31/00 206/524.1
2012/0248057 A1 * 10/2012 Bogle ..... A61J 1/1406 215/43
2013/0145726 A1 * 6/2013 Persson ..... B29C 65/18 53/373.2
2013/0197467 A1 * 8/2013 Schuetz ..... A61J 1/2093 604/416
2013/0233822 A1 * 9/2013 Aneas ..... B65D 51/002 215/317

FOREIGN PATENT DOCUMENTS

CN 201245424 Y 5/2009
WO WO 2005/063999 7/2005
WO WO 2005063999 A1 * 7/2005 ..... C11B 1/10
WO WO 2006002122 A2 1/2006
WO WO 2007/063218 6/2007

OTHER PUBLICATIONS

Extended European Search Report for PCT/AU2011001013; dated Dec. 13, 2013.
First New Zealand Examination Report dated Aug. 23, 2014 (English translation only).
European office action dated Nov. 4, 2014.

(56) References Cited

OTHER PUBLICATIONS

Second Chinese Office Action dated Jan. 29, 2015 (English translation submitted).

* cited by examiner

VIAL PREPARATION METHOD AND SYSTEM

CROSS-REFERENCE TO RELATED APPLICATIONS

The present application is a National Phase Application of International Patent Serial No. PCT/AU2011/001013, filed Aug. 5, 2011, which claims priority to both U.S. Provisional Application Ser. No. 61/371,318, filed Aug. 6, 2010 and to U.S. Provisional Application Ser. No. 61/434,928, filed Jan. 21, 2011, the contents of which are hereby incorporated by reference in their entireties and to each of which priority is claimed.

TECHNICAL FIELD

Described embodiments relate generally to methods and systems for vial preparation. Some embodiments relate to preparation of vials containing oxygen sensitive substances in solution.

BACKGROUND

Some pharmaceutical formulations are provided in a lyophilized powder form within a sealed vial for mixing with a liquid prior to administering the formulation to a patient. Mixing of the lyophilized formulation with its carrier liquid involves injection of the liquid into the vial using a syringe with a needle that punctures through a stopper that seals the opening of the vial. The mixed formulation is then aspirated and transferred into another carrier volume, such as a sealed bag of liquid to be suspended for delivery to a patient.

Lyophilization of the formulation is generally carried out in specialised lyophilization apparatus that freezes a liquid form of the formulation at low temperature and pressure, for example at about 0.05 mbar and about −10° C., and converts the formulation to lyophilized form by sublimation. The lyophilization apparatus generally comprises a condenser to condense water vapour sublimated from the formulation.

In some cases, a solution formulation is preferred. However, some solutions are oxygen sensitive and can suffer from stability problems with the formulation due to the inability to remove enough oxygen gas from the headspace of the vial and dissolved oxygen in solution prior to sealing it.

It is desired to address or ameliorate one or more shortcomings or disadvantages associated with existing preparation methods and systems, or to at least provide a useful alternative thereto.

SUMMARY

Some embodiments relate to a preparation method, comprising:

housing a plurality of vials in a temperature-controlled environment, wherein the plurality of vials each have a volume of a substance therein and each defines an unfilled volume therein, each vial having a stopper partially inserted into an opening of the vial so that gas can transfer between the unfilled volume and an external volume;

applying a vacuum to the environment to reduce pressure in the environment and in the unfilled volume of each vial to a first pressure level;

venting an inert gas into the environment to raise the pressure in the environment and in the unfilled volume of each vial to a second pressure level;

allowing the vials to rest in the environment at the second pressure level for a predetermined period;

repeating the applying, venting and allowing at least once; and fully inserting the stopper into each opening to seal each vial after the repeating.

The method may further comprise, after the repeating and prior to the fully inserting, once repeating only the applying and venting. The method may further comprise, after the fully inserting, capping each vial with a cap to retain the stopper in each vial. The housing may comprise housing the vials in lyophilization apparatus.

The method may further comprise, before the applying, controlling the temperature in the environment to be at or around a temperature set-point. The temperature set-point may be a first temperature set-point and the method may further comprise, after the venting, controlling the temperature in the environment to be at or around a second temperature set-point that is different from the first temperature set-point. This controlling of the temperature may be repeated along with the applying, venting and allowing.

For example, where there is a single temperature set-point used, the method may involve repeatedly controlling the temperature in the environment to be at or around the temperature set-point while repeating the applying, venting and allowing. Where first and second different temperature set-points are used, the repeating may involve repeatedly controlling the temperature to be at or around the first temperature set-point before applying the vacuum and repeatedly controlling the temperature to be at or around the second temperature set-point after the venting and before or during the allowing.

The method may involve at least one of:

- the first temperature set-point is less than about 10° C., optionally less than about 8° C., optionally about 5° C.; and
- the second temperature set-point is between about 17° C. and about 26° C.

The first temperature set-point may be at or below a freezing temperature of the substance, in which case the first pressure level may be between about 0.0001 mbar and about 10 mbar.

The method may further comprise allowing the vials to rest in the environment for another predetermined period at or around the second temperature set-point. The another period may be between about 15 minutes and about 45 or 60 minutes, optionally between about 25 and about 35 minutes, optionally about 30 minutes.

Where the first temperature set-point is greater than freezing, the first pressure level may be greater than about 10 mbar and less than about 500 mbar, optionally between about 10 mbar and about 300 mbar. The second pressure level may be between about 800 mbar and about 1000 mbar. The second pressure level may be between about 900 mbar and 950 mbar.

The housing may be performed at ambient pressure. The repeating of the applying, venting and allowing may be performed at least twice. The repeating of the applying, venting and allowing may be performed at least eight times. The repeating may be performed a number of times effective to reduce a dissolved oxygen content of the substance to about 0.4% or less. The repeating may be performed a number of times effective to reduce an oxygen gas content in the unfilled volume to less than or equal to about one percent. The repeating may be performed a number of times effective to reduce the oxygen gas content in the unfilled volume to between about 0.01% and about 0.6%.

Prior to the applying, the unfilled volume may contain a substantially atmospheric level of oxygen gas and/or the substance may contain a substantially atmospheric level of dissolved oxygen.

The predetermined time period may be between about 15 minutes and about 45 or 60 minutes, optionally between about 25 minutes and about 35 minutes.

The substance in a liquid form may comprise an oxygen-sensitive solution. The substance in a liquid form may be an aqueous solution free of volatile constituents. The substance in a liquid form may be stable at temperatures between about 1° C. and about 26° C. and pressures between about 10 mbar and 1000 mbar.

Some embodiments relate to a preparation method, comprising:

filling a plurality of vials with a predetermined volume of liquid so that an unfilled volume remains in each vial;

partially inserting a stopper into an opening of each vial so that gas can transfer between the unfilled volume of the vial and an external volume;

housing the vials in an environment in which the temperature is fixed at a selected temperature;

applying a vacuum to the environment to reduce pressure in the environment and in the unfilled volume of each vial to a first pressure level;

venting an inert gas into the environment to raise the pressure in the environment and in the unfilled volume of each vial to a second pressure level;

allowing the vials to rest in the environment at the second pressure level for a predetermined period;

repeating the applying, venting and allowing at least once; and fully inserting the stopper into each opening to seal each vial after the repeating.

The method may further comprise, prior to the fully inserting, once repeating only the applying and venting. The method may further comprise, after the fully inserting, sealing each vial with a cap to retain the stopper in each vial. The housing may comprise housing the vials in lyophilization apparatus that defines the environment.

The selected temperature may be around room temperature. The selected temperature may be between about 17° C. and about 26° C., for example including 18, 19, 20, 21, 22, 23, 24 and 25° C.

The first pressure level may be between about 200 mbar and about 500 mbar, optionally between about 300 mbar and about 350 mbar. The second pressure level may be between about 800 mbar and about 1000 mbar, optionally between about 900 mbar and 950 mbar. These pressure levels (and pressure levels referenced throughout this specification) are as measured using a thermal conductivity gauge.

The filling, partially inserting and housing may be performed at ambient/atmospheric pressure. Prior to the applying, the unfilled volume may contain a substantially atmospheric level of oxygen gas and the liquid may contain substantially an atmospheric level of dissolved oxygen.

The repeating of the applying, venting and allowing may be performed at least twice. In some embodiments, the repeating of the applying, venting and allowing may be performed at least eight times. The repeating may be performed until an oxygen gas content in the unfilled volume is less than or equal to about one percent. In some embodiments, the repeating may be performed until the oxygen gas content in the unfilled volume is between about 0.5% and about 0.6%. In some embodiments, the repeating may be performed until the dissolved oxygen content of the liquid is less than or equal to 0.4%.

The predetermined time period may be between about 15 minutes and about 45 or 60 minutes. In some embodiments, the predetermined time period may be between about 25 minutes and about 35 minutes and optionally around 30 minutes.

The liquid may comprise an oxygen-sensitive solution. The liquid may further comprise an aqueous solution free of volatile constituents. The solution may be stable (at least during the described preparation process) at temperatures between about 17° C. and about 26° C. and pressures between about 200 mbar and 1000 mbar.

Some embodiments relate to a preparation method, comprising:

filling a plurality of vials with a predetermined volume of liquid so that an unfilled volume remains in each vial;

partially inserting a stopper into an opening of each vial so that gas can transfer between the unfilled volume of the vial and an external volume;

housing the vials in a temperature-controlled environment;

applying a vacuum to the environment to reduce pressure in the environment and in the unfilled volume of each vial to a first pressure level;

venting an inert gas into the environment to raise the pressure in the environment and in the unfilled volume of each vial to a second pressure level;

allowing the vials to rest in the environment at the second pressure level for a predetermined period;

repeating the applying, venting and allowing at least once; and fully inserting the stopper into each opening to seal each vial after the repeating.

The method may further comprise, prior to the fully inserting, once repeating only the applying and venting. The method may further comprise, after the fully inserting, capping each vial with a cap to retain the stopper in each vial. The housing may comprise housing the vials in lyophilization apparatus.

The method may further comprise, before the applying, controlling the temperature in the environment to be at or around a temperature set-point. The temperature set-point may be a first temperature set-point and the method may further comprise, after the venting, controlling the temperature in the environment to be at or around a second temperature set-point that is different from the first temperature set-point. The repeating may comprise repeating the controlling of the temperature to be at or around the first and second temperature set-points at different times.

The first temperature set-point may be above freezing and less than about 10° C., 12° C. or 15° C., optionally between about 3° C. and about 8° C., optionally about 5° C. The second temperature set-point may be between about 17° C. and about 26° C.

The first pressure level may be between about 10 mbar and about 500 mbar, optionally between about 40 mbar and about 300 mbar. The second pressure level may be between about 800 mbar and about 1000 mbar, and in some embodiments between about 900 mbar and 950 mbar.

At least one of the filling, partially inserting and housing may be performed at ambient pressure.

The repeating of the applying, venting and allowing may be performed at least twice. The repeating of the applying, venting and allowing may be performed at least eight times or at least 12 times.

The repeating may be performed a number of times effective to reduce a dissolved oxygen content of the liquid to about 0.4% or less. The repeating may be performed a number of times effective to reduce an oxygen gas content in the unfilled volume to less than or equal to about one percent. The repeating may be performed a number of times effective to reduce the oxygen gas content in the unfilled volume to between about 0.01% and about 0.6%.

Prior to the applying, the unfilled volume may contain a substantially atmospheric level of oxygen gas and/or the liquid may contain a substantially atmospheric level of dissolved oxygen.

The predetermined time period may be between about 15 minutes and about 45 or 60 minutes, and in some embodiments between about 25 minutes and about 35 minutes.

The liquid may comprise an oxygen-sensitive solution. The liquid may be an aqueous solution free of volatile constituents. The liquid may be stable at temperatures between about 1° C. and about 26° C. and pressures between about 10 mbar and 1000 mbar.

Some embodiments relate to use of lyophilization apparatus to prepare a plurality of stoppered vials containing a liquid by a method comprising:

housing the plurality of vials containing the liquid in a closed chamber of the lyophilization apparatus, the vials each arranged to have a stopper partially inserted into an opening of the vial so that gas can transfer between an unfilled internal volume of the vial and an external volume;

controlling the lyophilization apparatus to substantially maintain a selected temperature above freezing in the chamber;

applying a vacuum to the chamber to reduce pressure in the chamber and in the unfilled volume of each vial to a first pressure level;

venting an inert gas into the chamber to raise the pressure in the chamber and in the unfilled volume of each vial to a second pressure level;

allowing the vials to rest in the chamber at the second pressure level for a predetermined time period;

repeating the applying, venting and allowing at least once; and fully inserting the partially inserted stopper into the opening of each vial to seal each vial after the repeating.

Some embodiments relate to use of lyophilization apparatus to prepare a plurality of stoppered vials containing a substance by a method comprising:

housing the plurality of vials containing the substance in a closed chamber of the lyophilization apparatus, the vials each arranged to have a stopper partially inserted into an opening of the vial so that gas can transfer between an unfilled internal volume of the vial and an external volume;

applying a vacuum to the chamber to reduce pressure in the chamber and in the unfilled volume of each vial to a first pressure level;

venting an inert gas into the chamber to raise the pressure in the chamber and in the unfilled volume of each vial to a second pressure level;

allowing the vials to rest in the chamber at the second pressure level for a predetermined time period;

repeating the applying, venting and allowing at least once; and fully inserting the partially inserted stopper into the opening of each vial to seal each vial after the repeating.

The controlling may comprise controlling the lyophilization apparatus to substantially maintain a first selected temperature for a first time period and to substantially maintain a second selected temperature for a second time period, where the first selected temperature is different from the second selected temperature. The second time period may occur during the allowing. The first time period may occur before and/or during the applying. The first selected temperature may be above or below freezing but less than about 10, 12 or 15 degrees and the second selected temperature may be between about 17 degrees and about 26 degrees.

The vials may initially be positioned on vertically spaced horizontal shelves in the chamber and the stoppers may be fully inserted into the vials by vertically compacting the shelves together. The condenser of the lyophilization apparatus may be disabled and isolated.

The use of the lyophilization apparatus may comprise, prior to the fully inserting, once repeating the applying and venting but not the allowing.

The selected temperature for the allowing when using the lyophilization apparatus may be around room temperature. The selected temperature may include a temperature between about 17° C. and about 26° C., optionally between about 18° C. and about 25° C. and preferably between about 20° C. and about 25° C., possibly between about 22° C. and about 24° C.

The first pressure level in use of the lyophilization apparatus may be between about 10 mbar and about 500 mbar, optionally between about 40 or 50 mbar and about 300 mbar. The second pressure level may be between about 800 mbar and about 1000 mbar, optionally between about 900 mbar and 950 mbar. Where the temperature in the apparatus or the vials prior to the applying is freezing or less (ie. where the substance is frozen), the first pressure level during the applying can be selected to be lower than where the substance is in a liquid state. Thus the first pressure level in such circumstances may be as low as 0.0001 mbar to 10 mbar. However, such low pressure levels would not be conducive to retaining a liquid in the vials and so would be eschewed for non-frozen substances.

Some embodiments relate to use of lyophilization apparatus wherein at least one of the filling, partially inserting and housing is performed at ambient pressure.

Repeating of the applying, venting and allowing may be performed at least twice. In some embodiments, the repeating of the applying, venting and allowing may be performed at least eight times. The repeating may include repeating the controlling.

The use of the lyophilization apparatus may include performing the repeating until an oxygen gas content in the unfilled volume is less than about one percent. The repeating may be performed until the oxygen gas content in the unfilled volume is between about 0.01% and about 0.6% and/or the dissolved oxygen content in the substance in liquid or frozen form is less than or equal to 0.4%.

Some embodiments of the use of the lyophilization apparatus may include, prior to the applying, the unfilled volume containing a substantially atmospheric level of oxygen gas. Prior to the applying, the substance in liquid or frozen form may contain a substantially atmospheric level of dissolved oxygen.

In some embodiments, the predetermined time period, the first time period and/or the second time period may be between about 15 minutes and about 45 or 60 minutes. In some embodiments, the predetermined time period, the first time period and/or the second time period may be between about 25 minutes and about 35 minutes. The second time period may be the predetermined time period.

In some embodiments of use of lyophilization apparatus, the substance in liquid form may comprise an oxygen-sensitive solution. In some embodiments, the substance in liquid form may be an aqueous solution free of volatile constituents. The substance in liquid form may be stable (at least during the described preparation process) at temperatures between about 1° C. and about 26° C. and pressures between about 10 mbar and 1000 mbar.

Some embodiments relate to modified lyophilization apparatus described herein and to vial preparation systems comprising such apparatus. Some embodiments relate to a system and/or apparatus (whether usable for lyophilization or not) specifically configured to perform the described methods. Some embodiments relate to a vial produced by the described processes and/or produced according to the described use of lyophilisation apparatus.

Some embodiments relate to a vial comprising:

a body having a neck and a single opening defined by the neck;

a stopper partly received in and sealing the opening;

a liquid contained by the body and the stopper, the liquid comprising an oxygen-sensitive formulation; and a headspace defined between the body, the liquid and the stopper;

wherein the stopper has at least one projection received in the opening, wherein the projection defines at least one gap or aperture which, when the projection is partially inserted into the opening, allows gas transfer between the headspace and a volume external of the vial.

The liquid may be an aqueous solution free of volatile constituents. The liquid may be stable at temperatures between about 1° C. and about 26° C. and pressures between about 10 mbar and 1000 mbar. An oxygen gas content in the headspace may be less than or equal to about one percent. The oxygen gas content in the headspace may be between about 0.01% and about 0.6%. A dissolved oxygen content in the liquid may be about 0.4% or less.

The vial may further comprise a cap seal to hold the stopper onto the neck. The stopper and vial body may be arranged so that, when the stopper is fully inserted into the opening, the disc-shaped top overlies a rim around the opening and the at least one gap is fully occluded by the rim, thereby sealing the vial from gas transfer between the unfilled volume and the external volume.

Some embodiments relate to a vial comprising:

a body having a neck and a single opening defined by the neck;

a stopper partly received in and sealing the opening;

a substance contained by the body and the stopper, the substance comprising an oxygen-sensitive formulation; and a headspace defined between the body, the substance and the stopper;

wherein the stopper has at least one projection received in the opening, wherein the projection defines at least one gap or aperture which, when the projection is partially inserted into the opening, allows gas transfer between the headspace and a volume external of the vial.

The substance may be in a liquid state or a frozen state. The substance in the liquid state may be an aqueous solution free of volatile constituents. The substance in the liquid state may be stable at temperatures between about 1° C. and about 26° C. and pressures between about 10 mbar and 1000 mbar.

DETAILED DESCRIPTION

Described embodiments relate generally to methods and systems for vial preparation. Some embodiments relate to preparation of vials containing oxygen sensitive substances in solution.

Illustrated embodiments are described herein, by way of example and not limitation, with reference to the drawings, and FIGS. 1, 2A, 2B, 3 and 6 in particular.

Figure 1:
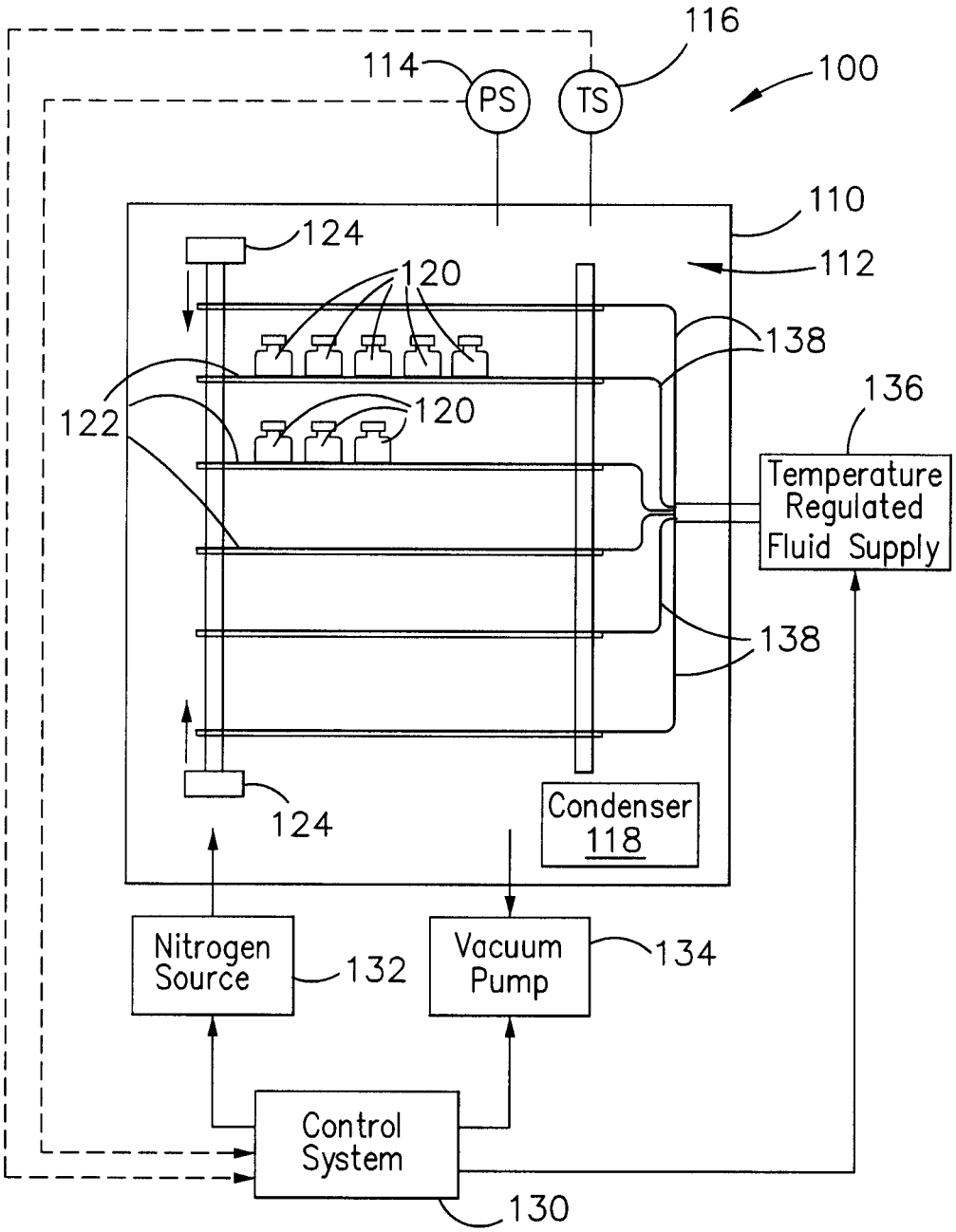
FIG. 1 is a schematic diagram of a system for preparation of vials according to described embodiments.

Referring now to FIG. 1, lyophilization apparatus 100 is described in further detail. Lyophilization apparatus 100 may normally perform a freeze-drying function in order to lyophilize solutions contained in vials positioned within a chamber of the apparatus. For present embodiments, however, lyophilization apparatus 100 is not used for such a lyophilization process and does not freeze-dry the solution within the vials. Rather, lyophilization apparatus 100 houses a plurality of vials 120 on shelves 122 within a chamber 112 defined by a housing 110 of the apparatus 100, with the vials 120 being maintained at a temperature above freezing and in some instances around room temperature or in a range thereabouts, such as between about 17° C. and about 26° C., and optionally between about 20° C. and about 25° C. In some embodiments, the chamber 112 is controlled during part of the process to be in a lower temperature range above freezing and less than about 10, 12 or 15 degrees C., optionally around 3° C. to 8° C., optionally around 5° C.

The lyophilization apparatus 100 may comprise part of a larger system for vial preparation, such as an automated vial preparation system that includes vial filling equipment, stopper (partial) insertion equipment and vial capping equipment, together with suitable vial transport mechanisms to transport the vials between such equipment as part of the overall preparation process.

In some embodiments, apparatus 100 may not be configured as lyophilization apparatus, but may instead comprise purpose-built equipment specifically configured to perform the functions described herein. Thus, some embodiments described herein include apparatus that is not specifically configured for lyophilization and the functions and components described herein in relation to lyophilization apparatus 100 should be understood to be comprised in some embodiments of apparatus 100 that do not perform lyophilization.

Lyophilization apparatus 100 also comprises a pressure sensor 114 to sense the pressure level within the chamber 112 and a temperature sensor 116 to sense the temperature within the chamber 112. The pressure sensor 114 may comprise a thermal conductivity Pirani gauge, for example. Other forms of pressure sensor can be used to determine pressure levels in the chamber 112 but units and/or base reference values of such sensors may need to be modified to correspond with the numerical pressure values described herein.

Lyophilization apparatus 100 further comprises an automated control system 130 to receive data signals corresponding to the output of pressure and temperature sensors 114, 116. Such data signals are used by control system 130 to ensure that the appropriate pressure and temperature set-points are achieved during the vial preparation process.

Control system 130 may comprise a computer executing suitable software and having suitable interface components to receive user input, receive and process instrumentation signals and exert control over the various described apparatus components. Control system 130 may comprise one or more additional control components in communication with and/or responsive to the computer to more directly interact with various system components associated with apparatus 100.

Lyophilization apparatus 100 further comprises a sterile, filtered inert gas source 132, such as nitrogen gas, a vacuum pump 134 and a temperature regulated fluid supply 136. Supply of the inert gas from inert gas source 132 to the chamber 112 is performed under the control of control system 130 operating existing control software such as is commonly available from suppliers of lyophilization apparatus. A pressure regulator (not shown) controlled by control system 130 may be coupled intermediate the inert gas source 132 and the chamber 112 to control the pressure and flow rate at which the inert gas is vented into the chamber 112. For example, the pressure regulator may be set by the control system 130 to supply the inert gas into chamber 112 at pressures of around 1 to 1.5 bar. Similarly, vacuum pump 134 is operated under control of control system 130 to evacuate gas from chamber 112 and cause the pressure level within the chamber 112 to decrease to a pressure level set by user configuration input to control system 130.

Temperature regulated fluid supply 136 is operated under the control of control system 130 to provide fluid, such as oil, at a set temperature to the shelves 122 that support the vials 120. Fluid of the set temperature is supplied to shelves 122 from temperature regulated fluid supply 136 via a plurality of supply conduits 138 coupled to respective shelves 122. Thus, the shelves 122 provide a means for controlling the temperature of the vials 120, and to some extent the temperature of the chamber environment, within the chamber 112. Additional temperature control means, such as additional heating/cooling elements, may be provided to more directly control the temperature of the environment within the chamber 112.

If pre-existing lyophilization apparatus is used as the lyophilization apparatus 100 of the described embodiments, it may include a condenser 118 coupled to the housing 110. For present purposes, use of such a condenser 118 in the described process is undesirable and the condenser 118 is preferably disabled. The condenser is designed to draw vapour out of the chamber as a result of the temperature differential (−75° C.), but because the formulation is in the solution form, it is not desirable to have the vapour drawn from the chamber because evaporation of the formulation would increase. It has been found that evaporation of the solution can be in the vicinity of 0.3-0.4% using the described methods and systems. Increasing this evaporation rate may result in an undesirable effect on the formulation.

Lyophilization apparatus 100 further comprises means for moving shelves 122 vertically to separate or compact them. In described embodiments, movement of the shelves 122 can be effected by one or more hydraulic movement mechanisms 124 acting directly or indirectly on the shelves 122. As described in further detail below, vertical compaction of shelves 122 is used to force stoppers that are partially inserted into the vials 120 to become fully inserted into the vials 120.

Figure 2A:
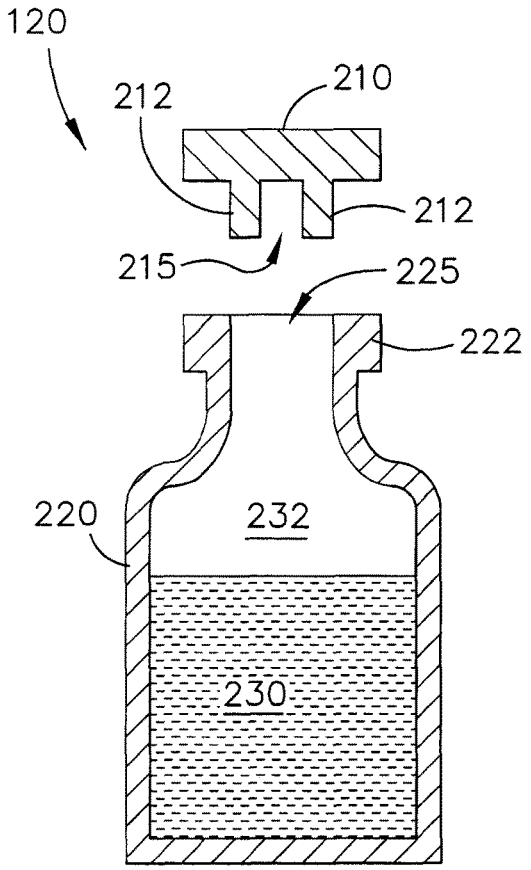
FIG. 2A is a sectional view of a vial and stopper prior to partial insertion of the stopper into the vial into an opening defined by the neck of the vial.
Figure 2B:
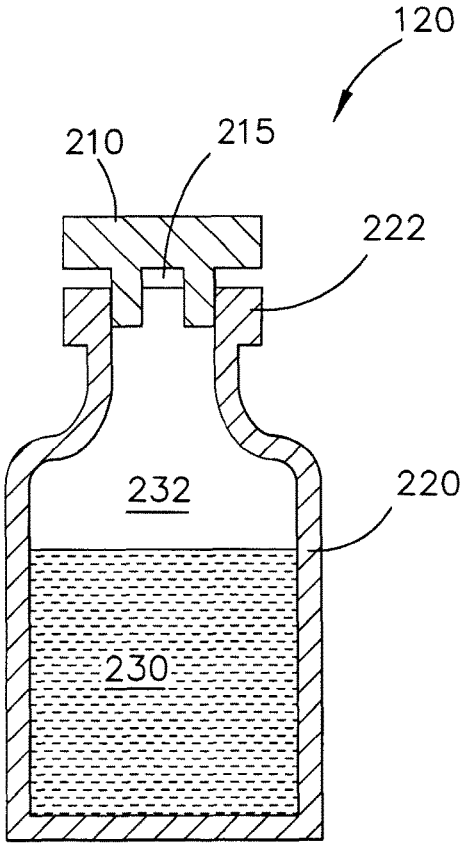
FIG. 2B is a sectional view of the vial and stopper with the stopper partially inserted into the vial opening.

Referring now to FIGS. 2A and 2B, the arrangement of the stoppers and the vials 120 is illustrated and described in further detail. Each vial 120 is of generally conventional form, having a generally cylindrical body, including a base, side walls 220 and a neck having an opening 225 defined by a slightly thickened (relative to walls 220) annular rim or head portion 222. When a liquid formulation 230 is contained within the side walls 220, a headspace 232 is defined between the surface of the liquid 230 and the opening 225. This headspace will, under atmospheric conditions, generally include an atmospheric level of oxygen gas, which is desirably removed from the headspace 232 when the liquid 230 is an oxygen-sensitive formulation.

The liquid may comprise an aqueous solution free of volatile constituents and stable (at least during the described preparation process) at temperatures between about 1° C. and about 26° C. and pressures between about 10 mbar and 1000 mbar. By way of example and without limitation, the liquid formulation may be suitable for use as a pharmaceutical composition and may comprise an oxygen-sensitive cancer treatment formulation, an oxygen-sensitive cardiovascular treatment formulation, an oxygen-sensitive anaesthetic formulation, an oxygen-sensitive pain management formulation or an oxygen-sensitive antibiotic formulation.

Each stopper 210 is of a commonly available type comprised of rubber or other suitable materials, with the top of the stopper 210 being generally disc shaped and having a pair of downward projections 212 that define a straight diametrical slot or gap 215 therebetween. Thus, diametrical gap 215 extends along a diameter line through what would otherwise be a cylindrical boss extending downwardly from the disc-shaped top. Downward projections 212 resemble circular segments disposed oppositely across the diametrical gap 215, as is illustrated in FIGS. 2A and 2B.

Embodiments of stopper 210 may include one or more apertures 215 formed in one or more downward projections 212 from the disc-shaped top. The arrangement of the apertures 215 is less important than that at least one aperture 215 allows adequate gas transfer between the headspace 232 and an external volume (i.e. chamber 112) when the stopper 210 is partially inserted and under the described temperature and pressure conditions. Some embodiments of the stopper 210 may employ a single widened aperture 215 rather than two opposed apertures 215 arranged to define two ends of a gap or slot.

The vials 120 used to contain the liquid 230 may be glass or glass-like vials or other suitably sterile transparent vials that are commercially available from various suppliers, including Nuova Ompi or Daikyo Seiko, Ltd, for example. Further, the stoppers 210 may be suitable commercially available elastomeric stoppers, such as those made or distributed by Daikyo Seiko, Ltd or West Pharmaceutical Services, Inc. As noted above, the stoppers 210 may define a single aperture 215 in some embodiments or more than one aperture 215 in other embodiments.

FIG. 2A illustrates the vial 120 just prior to partial insertion of the stopper 210 into opening 225, while FIG. 2B illustrates the vial 120 with the stopper 210 partially inserted into the opening 225. The partial insertion of the stopper 210 is performed so that the diametrical gap 215 between the two projections 212 is only partially occluded by the rim and thus allows gas flow between the headspace 232 and volumes external of the vial 120. In the partially inserted state, friction between the projections 212 and the inside surface of the rim 222. This arrangement allows gas, such as oxygen gas, within the headspace 232 to be evacuated and subsequently replaced with an inert gas, such as nitrogen gas, according to the process described below in relation to FIG. 3.

Once the gas transfer process is complete, the partially inserted stoppers 210 are pushed toward the vials 120 by shelves 122 so that projections 212 of the stopper 210 become fully inserted within opening 225 and the diametrical gap 215 becomes fully occluded by the annular rim 222, thereby closing off gas transfer between headspace 232 and volumes external of the vial 120. Thus, when the stopper 210 is fully inserted into the opening of the vial 120, outer circumferential portions of the stopper 210 overlie the thickened annular rim 222 and substantially seal therewith. A cap (not shown) can then be placed around the stopper 210 and annular rim 222 to ensure that the seal between the stopper 210 and the neck of the vial 120 remains intact.

Figure 3:
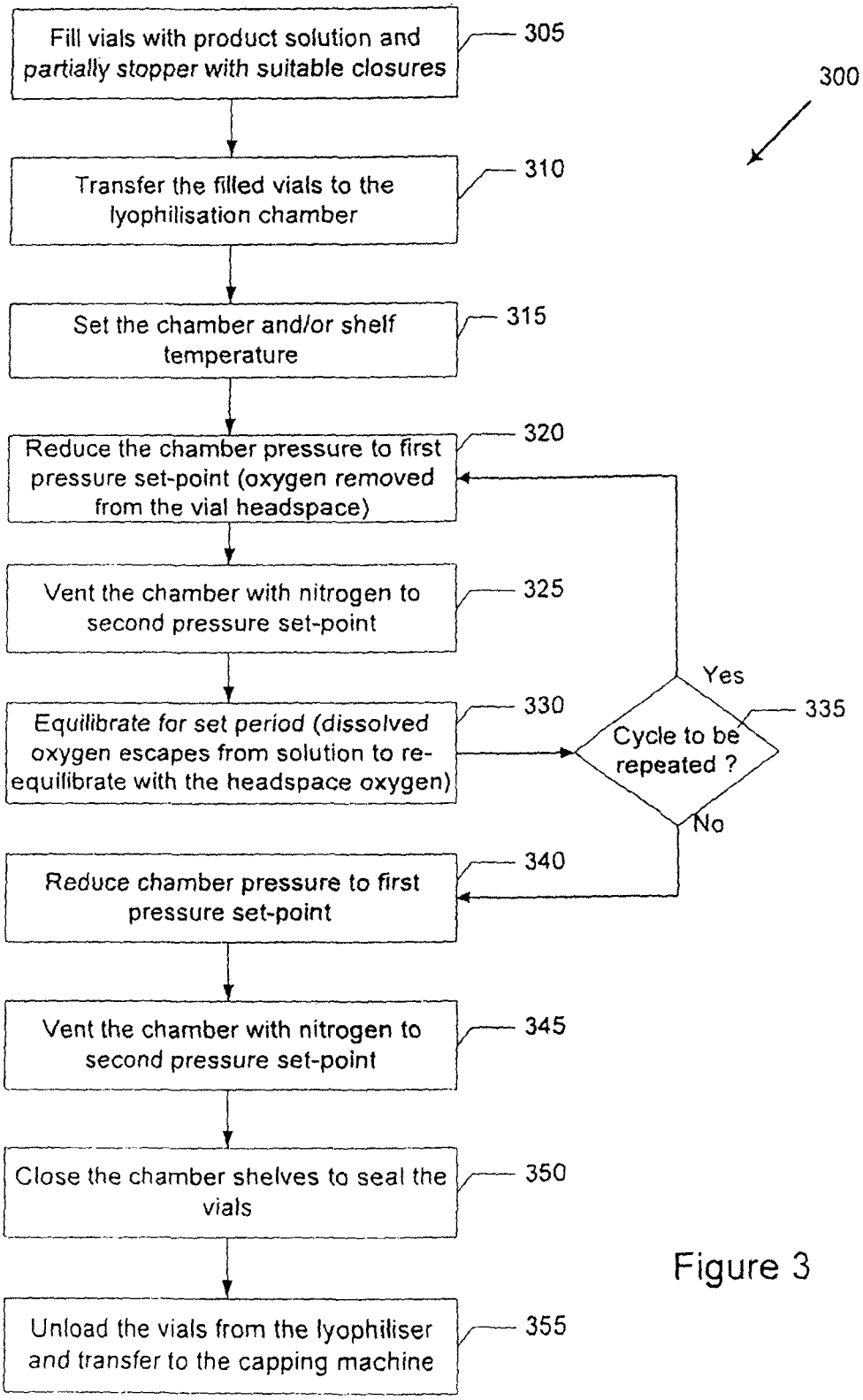
FIG. 3 is a flow chart of a method of vial preparation according to some embodiments.

Referring now to FIG. 3, a method 300 of preparing the vials 120 is described in further detail. The method 300 begins at step 305, in which vials 120 are filled with solution 230 using known filling equipment and then partially stoppered using stoppers 210 (as shown in FIG. 2B) or other suitable closures using known stopper insertion equipment.

At step 310, the filled vials 210 are transferred into chamber 112 of lyophilization apparatus 100. The shelf temperature of shelves 122 may then be set at step 315 by control system 130 transmitting suitable control signals to temperature regulated fluid supply 136. Step 315 may be performed prior to step 310 or simultaneously therewith in alternative embodiments. Step 315 may also involve manipulating other temperature control means, such as a heater and/or cooler, to achieve the desired set temperature of the environment within chamber 112.

At step 320, vacuum pump 134 is operated under the control of the control system 130 to evacuate the chamber 112, reducing the pressure in the chamber to a first pressure level (set-point) between about 200 mbar and about 500 mbar, preferably between about 300 mbar and 350 mbar. This has the effect of removing most or all of the oxygen gas from the chamber 112, including oxygen gas in the headspace 232 of the vials 120, extracted through the partially occluded diametrical gap 215.

Next, at step 325, control system 130 controls the supply of inert gas from inert gas source 132 to vent the inert gas into the chamber 112, thereby increasing the pressure in the chamber 112 to a second level (set-point) between about 800 mbar and 1000 mbar. Preferably, the second pressure level is slightly less than atmospheric pressure (i.e. around 900 mbar to around 950 mbar), so that the chamber 112 remains at a slightly negative pressure relative to the external atmosphere.

Once the nitrogen (or other inert gas, such as argon, helium or carbon dioxide, for example) has been vented into the chamber 112 at step 325, the vials 120 are allowed to equilibrate for a pre-configured period of time at step 330. This period of time may be in the order of 15 to 45 or 60 minutes or 20 to 40 minutes, preferably between about 25 and 35 minutes and optionally around 30 minutes. This equilibration allows dissolved oxygen in the solution 230 to equilibrate with the lower oxygen level in the headspace 232, thereby decreasing the dissolved oxygen in the solution 230 and increasing the oxygen gas content in the headspace 232. This increased oxygen gas content in the headspace 232 can then be extracted in the next evacuation of chamber 112, thereby incrementally reducing the oxygen content in a non-linear, asymptotic fashion as the evacuation and venting are repeated.

At step 335, control system 130 determines whether a further cycle of pressure reduction, inert gas venting and equilibration (i.e. steps 320 to 330) is required according to pre-configured process parameters. If a further cycle is required, the steps 320 to 335 are repeated. Otherwise, control system 130 proceeds to step 340, at which the pressure in the chamber 112 is again reduced to about 200 to 500 mbar (optionally 300 to 350 mbar) as in step 320. Control system 130 then vents the chamber with an inert gas at step 345, as in step 325.

Steps 340 and 345 are therefore a once-only repetition of steps 320 and 325 as a final stage (without allowing equilibration) of oxygen extraction before the vials 120 have their stoppers fully inserted by compaction of the shelves 122 at step 350. As part of step 350, control system 130 causes hydraulic movement mechanisms 124 to vertically compact the shelves 122, thereby pushing the partially stoppered vials 120 (i.e. as in FIG. 2B) fully into the vial openings 225, thereby sealing the headspace 232 against further gas transfer.

Once the shelves 122 have compacted to seal the vials 120, the control system 130 causes hydraulic movement mechanism 124 to expand the shelves 122 and allow the vials to be unloaded from the chamber 112 for transfer to a capping machine (not shown) at step 355. The application of the caps ensures that the seal between the stopper 210 and the neck of the vial 120 is maintained.

Generally, method 300 will involve repetition of at least 8 cycles of steps 320 to 330, for example for small vials up to about 5 mL or 10 mL, and at least 12 times for larger vials, for example up to around 20 mL. For even larger vial sizes, the number of cycles can be increased further. Such numbers of cycle repetitions are determined to be suitable for reducing the oxygen gas content in the headspace 232 from atmospheric oxygen gas levels to around 0.5 to 0.6%, which is a desirable level, although levels of 1% or less oxygen gas content are considered to be suitable. Such numbers of cycles are also effective to reduce the dissolved oxygen content in the solution from atmospheric levels around 7 to 8 ppm to about 0.3 or 0.4%, which is considered to be an acceptable level for oxygen-sensitive solutions.

Figure 6:
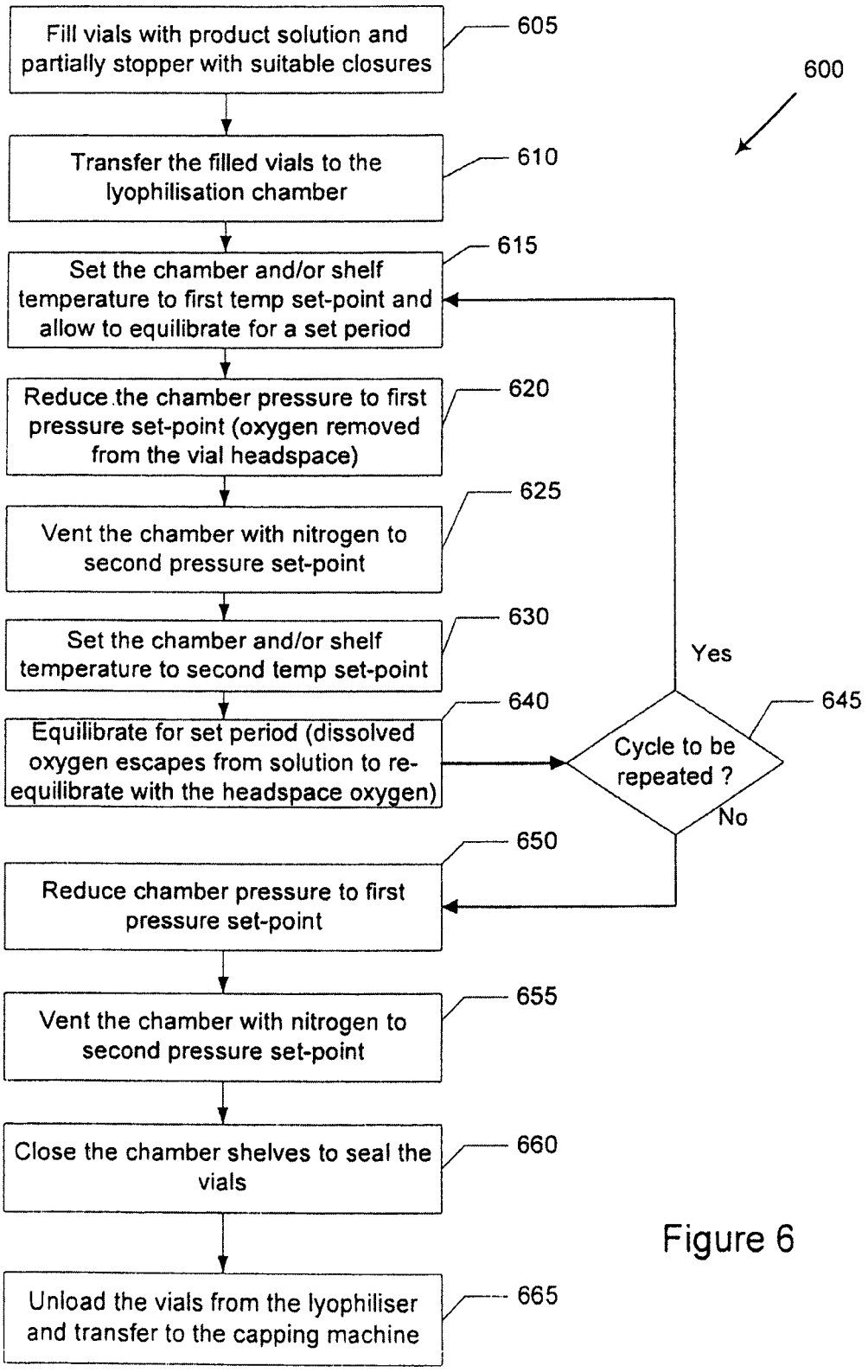
FIG. 6 is a flow chart of an alternative method of vial preparation according to some embodiments

Referring now to FIG. 6, an alternative method 600 of preparing the vials 120 is described in further detail. The method 600 begins at step 605, in which vials 120 are filled with solution 230 using known filling equipment and then partially stoppered using stoppers 210 (as shown in FIG. 2B) or other suitable closures using known stopper insertion equipment.

At step 610, the filled vials 210 are transferred into chamber 112 of lyophilization apparatus 100. Steps 610 to 665 need not be performed at the same location as step 605. The shelf temperature of shelves 122 may then be set to a desired first temperature set-point at step 615 by control system 130 transmitting suitable control signals to temperature regulated fluid supply 136. The first set-point may be a temperature lower than room temperature, for example above or below freezing but less than about 15° C. or less than about 10° C. or 12° C., for example.

Step 615 may be performed prior to step 610 or simultaneously therewith in alternative embodiments. Step 615 may also involve manipulating other temperature control means, such as a heater and/or cooler, to achieve the desired set temperature of the environment within chamber 112.

As part of step 615 or as a separate step, the vials 210 are allowed to rest at the first temperature set-point for a predetermined period, such as between about 15 minutes and about 45 or 60 minutes, optionally about 25 minutes to about 35 minutes, optionally about 30 minutes.

At step 620, vacuum pump 134 is operated under the control of the control system 130 to evacuate the chamber 112, reducing the pressure in the chamber to a first level (set-point) between about 10 mbar and about 500 mbar, optionally between about 40 or 50 mbar and 300 mbar, optionally 50 mbar to 100 mbar. This has the effect of removing most or all of the oxygen gas from the chamber 112, including oxygen gas in the headspace 232 of the vials 120, extracted through the partially occluded diametrical gap 215. Step 620 need only be performed for a short time (for example at least one order of magnitude less) compared to the rest time required in step 640 below.

Where the temperature in the chamber 112 or the vials 120 prior to step 620 is freezing or less (ie. where the substance is frozen), the first pressure set-point during the evacuation step 620 can be selected to be lower than where the substance is in a liquid state. Thus the first pressure level in such circumstances may be as low as 0.0001 mbar to 10 mbar. Such low pressures may assist in more efficiently removing oxygen from the headspace 232. However, such low pressure levels would not be conducive to retaining a liquid in the vials and so would be eschewed for non-frozen substances in the vials 120. If the first temperature set-point is freezing or less, then the solution 230 would repeatedly transition between a liquid state and a frozen state during the process according to such embodiments. Depending on the sensitivity of the solution 230 to such repeated changes, this may or may not be desirable. Additionally, the additional time taken to transition between liquid and frozen states may be significant, particularly when multiplied by the number of cycles to be performed in process 600.

Next, at step 625, control system 130 controls the supply of inert gas from inert gas source 132 to vent the inert gas into the chamber 112, thereby increasing the pressure in the chamber 112 to a second level (set-point) between about 800 mbar and 1000 mbar. Preferably, the second pressure level is slightly less than atmospheric pressure (i.e. around 900 mbar to around 950 mbar), so that the chamber 112 remains at a slightly negative pressure relative to the external atmosphere.

Simultaneously with, or subsequent to, the pressure increase at step 625, the shelf temperature and/or chamber temperature may be set at step 630 to a second temperature set-point that is around room temperature, such as 17° C. to 26° C., optionally 22° C. to 24° C.

Once the nitrogen (or other inert gas, such as argon, helium or carbon dioxide, for example) has been vented into the chamber 112 at step 625, the vials 120 are allowed to equilibrate for a pre-configured period of time at step 640. This period of time may be in the order of 15 to 45 or 60 minutes or 20 to 40 minutes, preferably between about 25 and 35 minutes and optionally around 30 minutes. The equilibration period may start once the shelf temperature reaches the second set-point or it may start once the pressure reaches its newly raised set-point, for example. The equilibration period of step 640 may instead start once the second temperature set-point is set at step 630 but before the shelves 122 and/or chamber 112 reach that second temperature set-point. This equilibration allows dissolved oxygen in the solution 230 to equilibrate with the lower oxygen level in the headspace 232, thereby decreasing the dissolved oxygen in the solution 230 and increasing the oxygen gas content in the headspace 232. This increased oxygen gas content in the headspace 232 can then be extracted in the next evacuation of chamber 112, thereby incrementally reducing the oxygen content in a non-linear, asymptotic fashion as the evacuation and venting are repeated.

At step 645, control system 130 determines whether a further cycle of temperature and pressure reduction, inert gas venting, temperature increasing and equilibration (i.e. steps 615 to 640) is required according to pre-configured (in control system 130) process parameters. If a further cycle is required, the steps 615 to 640 are repeated. Otherwise, control system 130 proceeds to step 650, at which the pressure in the chamber 112 is again reduced to about 10 to 500 mbar (optionally 40 or 50 to 300 mbar) as in step 620. Control system 130 then vents the chamber with an inert gas at step 655, as in step 625.

Steps 650 and 655 are therefore a once-only repetition of steps 620 and 625 as a final stage (without allowing equilibration) of oxygen extraction before the vials 120 have their stoppers fully inserted by compaction of the shelves 122 at step 660. As part of step 660, control system 130 causes hydraulic movement mechanisms 124 to vertically compact the shelves 122, thereby pushing the partially stoppered vials 120 (i.e. as in FIG. 2B) fully into the vial openings 225, thereby sealing the headspace 232 against further gas transfer.

Once the shelves 122 have compacted to seal the vials 120, the control system 130 causes hydraulic movement mechanism 124 to expand the shelves 122 and allow the vials to be unloaded from the chamber 112 for transfer to a capping machine (not shown) at step 665. The application of the caps ensures that the seal between the stopper 210 and the neck of the vial 120 is maintained.

Generally, method 600 may involve repetition of at least 8 cycles of steps 615 to 640, for example for small vials up to about 5 mL and 10 mL, and at least 12 times for larger vials, for example up to around 20 mL. For even larger vial sizes, the number of cycles can be increased further. Such numbers of cycle repetitions are determined to be suitable for reducing the oxygen gas content in the headspace 232 from atmospheric oxygen gas levels to less than 0.6%, for example around 0.01 to 0.3%, which is a desirable level, although levels of 1% or less oxygen gas content are considered to be acceptable. Such numbers of cycles are also effective to reduce the dissolved oxygen content in the solution from atmospheric levels around 7 to 13 ppm to about 0.01 to 0.6%, which is considered to be an acceptable level for oxygen-sensitive solutions.

The low level of oxygen gas in the headspace 232 achievable using the described techniques is believed to be substantially below the levels obtainable using other techniques where there is a liquid formulation in the vial. Additionally, the described methods allow the liquid volume of the formulation to remain substantially the same throughout the vial preparation process, apart from some slight evaporation, for example in the order of 0.3-0.4% by weight or less.

Depending on the vial size and the starting oxygen gas content in the headspace 232, fewer or greater numbers of cycles of steps 320 to 330 or steps 615 to 640 may be desirable. It is believed that in some circumstances, 2, 3, 4, 5, 6, 7, 9, 10 or 11 cycles would yield beneficial results in terms of reducing the possible deleterious effect of oxygen gas contained in the headspace 232 to the oxygen sensitive solution 230.

While embodiments are described in the context of using lyophilization apparatus 100 to perform the described methods, other suitable apparatus not configured specifically for lyophilization can be used, providing that such apparatus has: a sealable chamber, a vacuum pump that can be controlled to achieve pressures between about 0.0001 mbar (if freezing temperatures are used) or about 10 mbar (for above-freezing temperatures) and atmospheric pressure (about 1000 mbar) in the chamber, inert gas venting capability, environmental temperature control between 17 and 26° C. (preferably 20° C. to 25° C.) and has mechanical means (such as hydraulic shelves) for fully inserting the partially inserted stoppers into the vials for sealing. This sealing of the vials is to be performed prior to the vials 120 being exposed to atmospheric levels of oxygen gas.

It should be noted that the indicated vial sizes do not necessarily contain the amount of liquid 230 that corresponds to the vial size, but may contain more or less than the stated nominal capacity of the vial 120. For example, the 5 mL and 10 mL vials may contain about 4 mL and 9 mL respectively of liquid 230, while the 20 mL vial size may contain about 15 mL of liquid 230. The vial sizes are thus referenced as being indicative of approximate capacity (to a level below the shoulder of the vial) rather than necessarily indicating the actual contained volume of liquid 230 within such vials 120.

EXAMPLES

Figure 4:
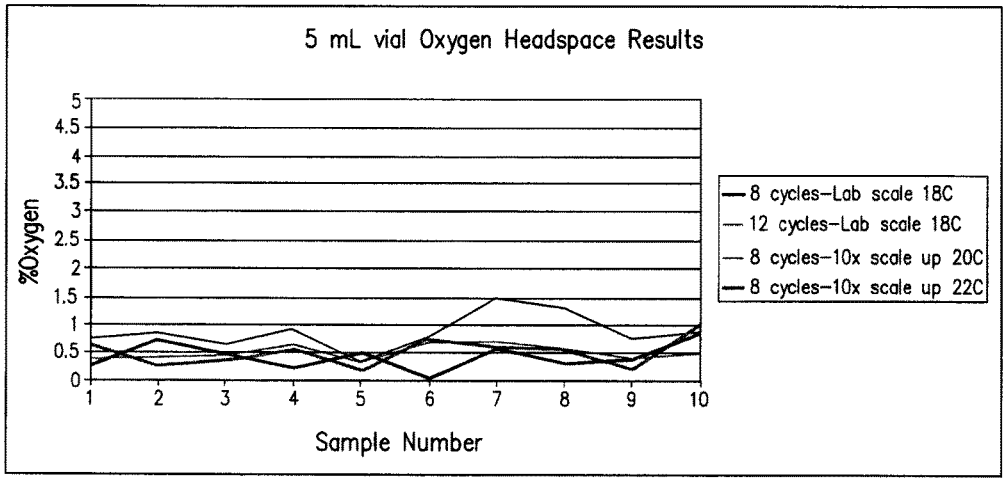
FIG. 4 is a graph of measured percentage oxygen gas content in the vial headspace for a series of experiments using 5 mL vials.
Figure 5:
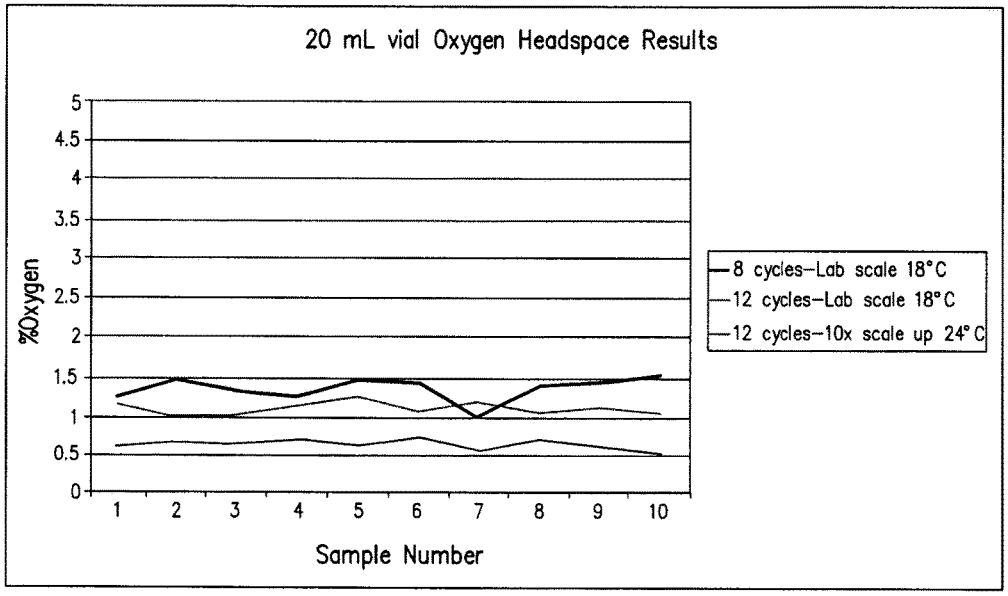
FIG. 5 is a graph of measured percentage oxygen gas content in the vial headspace for a series of experiments using 20 mL vials.

Some experiments have been conducted in order to verify that desirable oxygen gas levels in the headspace within a practical number of cycles of steps 320 to 330, and the results of these experiments are shown in the graphs of FIG. 4 (for 5 mL vials) and FIG. 5 (for 20 mL vials), the data of which is respectively tabulated in Table 1 and Table 2 below. Using the same lyophilizer apparatus, some of the experiments were conducted on small lab scale (i.e. about 10 vials) equipment, and some further larger lab scale experiments were conducted at a scale roughly ten times that of the small lab scale (i.e. 100-150 vials). Experiments were also conducted on a laboratory scale with 10 mL vials, the results of which are tabulated in Table 3 below. These 10 mL vials had a 20 mm (outside) diameter neck size.

Different temperature set points (applied both during reduced pressure and at 900 mbar) were used in the experiments conducted according to method 300, and it has been found that, within a range of 18 to 24° C., temperatures around 22° C. and 24° C. have been found to facilitate generally lower percentages of oxygen content in the headspace 232 and this is thought to be due to the decrease in oxygen solubility in solution at higher temperatures. It has also been found that greater numbers of cycles generally results in lower oxygen gas content in the headspace 232.

TABLE 1

| Headspace Oxygen Results (% $O_2$) | | | | |
|---|---|---|---|---|
| 5 mL vial - Laboratory scale | | 5 mL vial - Scale-up (10x) | | 5 mL vial - Production scale 8 to 10 |
| 8 cycles - 18° C. | 12 cycles - 18° C. | 8 cycles - 20° C. | 8 cycles - 22° C. | cycles - (5° C.-22° C.) (as per FIG. 6 cycle) |
| 0.278 | 0.378 | 0.769 | 0.640 | 8 cycles |
| 0.737 | 0.440 | 0.854 | 0.288 | Av. = 0.76% |
| 0.444 | 0.453 | 0.647 | 0.353 | |
| 0.217 | 0.651 | 0.936 | 0.572 | |
| 0.507 | 0.356 | 0.367 | 0.185 | |
| 0.061 | 0.671 | 0.778 | 0.745 | 10 cycles |

TABLE 1-continued

| Headspace Oxygen Results (% $O_2$) | | | | |
|---|---|---|---|---|
| 5 mL vial - Laboratory scale | | 5 mL vial - Scale-up (10x) | | 5 mL vial - Production scale 8 to 10 |
| 8 cycles - 18° C. | 12 cycles - 18° C. | 8 cycles - 20° C. | 8 cycles - 22° C. | cycles - (5° C.-22° C.) (as per FIG. 6 cycle) |
| 0.558 | 0.717 | 1.466 | 0.596 | Av. = 0.74% |
| 0.317 | 0.563 | 1.281 | 0.544 | |
| 0.399 | 0.434 | 0.758 | 0.190 | |
| 0.864 | 0.514 | 0.894 | 0.985 | |

TABLE 2

| Headspace Oxygen Results (% $O_2$) | | | |
|---|---|---|---|
| 20 mL vial - Laboratory scale | | 20 mL vial - | 20 mL vial - Production scale 8 to 12 |
| 8 cycles - 18° C. | 12 cycles - 18° C. | Scale-up (10x) 12 cycles - 24° C. | cycles - (5° C.-24° C.) (as per FIG. 6 cycle) |
| 1.223 | 1.135 | 0.607 | 8 cycles |
| 1.447 | 0.970 | 0.661 | Av. = 0.45% |
| 1.303 | 1.002 | 0.638 | |
| 1.228 | 1.123 | 0.690 | |
| 1.456 | 1.238 | 0.619 | |
| 1.413 | 1.054 | 0.720 | 12 cycles |
| 0.974 | 1.188 | 0.552 | Av. = 0.21% |
| 1.397 | 1.045 | 0.718 | |
| 1.429 | 1.114 | 0.600 | |
| 1.528 | 1.043 | 0.554 | |

TABLE 3

| Headspace Oxygen Results (% $O_2$) 10 mL vial - Laboratory scale 6 cycles - (5° C.-22° C.) |
|---|
| 0.25% |
| 0.12% |
| 0.06% |
| 0.20% |
| 0.09% |
| 0.33% |
| 0.20% |
| 0.18% |
| 0.13% |
| 0.19% |
| Av. = 0.18% |

The cycle conditions (according to the process of FIG. 6) used for the 10 mL vial were:

1. Shelf Temp: 5° C.
2. Equilibration: 30 mins
3. Pressure: 100 mbar
4. Vent Pressure (Nitrogen): 900 mbar
5. Shelf Temp: 22° C.
6. Equilibration: 30 mins
7. Repeat Steps: 1 to 6 (6 times)

It was observed that the process worked more efficiently with a 20 mm (OD) vial neck size, as opposed to a 13 mm (OD) vial neck size, in relation to the evaporation rate. Use of an igloo shaped stopper (i.e. having a single aperture wider than the two opposed apertures of other stoppers) was also found to reduce evaporation rate.

While theoretically a near-zero oxygen gas content in the headspace 232 could be achieved by performance of a large number of cycles (i.e. more than, say, 30) of steps 320 to 330 or 615 to 640, there are practical limitations on doing so, given that each cycle requires a time period for allowing equilibration of oxygen levels between the solution 230 and the headspace 232.

Some further larger scale trials (using 336 20 ml vials and 1666 5 ml vials) were conducted for the method 600 described in relation to FIG. 6. The modified methodology was employed in order to increase the likelihood of achieving a sufficiently low headspace oxygen level at commercial production scales.

A comparison of the headspace oxygen levels measured following the trials of methods 300 and 600 (FIGS. 3 and 6, respectively) is provided in Table 4 below. The results for "FIG. 3 Cycle" in Table 4 are drawn from the data in the columns labelled "10× scale-up" of Tables 1 and 2 above.

TABLE 4

| Experiment | Vial Size | No. of Cycles | Shelf Temp | Average Headspace Oxygen | Average Weight Lost |
|---|---|---|---|---|---|
| FIG. 3 Cycle | 5 mL | 8 | 22° C. | 0.54% | 0.41% |
| FIG. 6 Cycle | 5 mL | 8 to 12 | 5° C.-22° C. | 0.20% | 0.43% |
| FIG. 3 Cycle | 20 mL | 12 | 24° C. | 0.64% | 0.38% |
| FIG. 6 Cycle | 20 mL | 8 to 12 | 5° C.-24° C. | 0.30% | 0.37% |
| FIG. 6 Cycle | 10 mL | 6 | 5° C.-22° C. | 0.18% | 0.38% |

The headspace oxygen levels of 0.20% and 0.30% are averages, with the underlying data ranging above and below such levels. The lowest headspace oxygen level achieved in the trials of method 600 were close to 0.01%.

All of the experiments were conducted using a lyophiliser apparatus made by Leybold-Heraeus GmbH having the following characteristics:

Inner chamber dimensions: 950×800×4 mm (diameter×length×thickness)

Product shelves: 7 shelves, 1 radiation plate 600×450 mm

Heat transfer medium: Silicone Oil Baysilon M3

Vacuum pump nominal flow rate: 38 $m^2$/hour (at atmospheric pressure)

Air inlet connected to nitrogen gas supply

Measurement of the oxygen gas content was performed using a laser-based non-destructive testing technique. The level of dissolved oxygen in the solution was calculated from the measured oxygen gas content.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

Any discussion of documents, acts, materials, devices, articles or the like which has been included in the present specification is solely for the purpose of providing context for the present invention. It is not to be taken as an admission that any or all of these matters form part of the prior art base or were common general knowledge in the field relevant to the present invention as it existed before the priority date of each claim of this application.

Some variation and/or modification may be made to the described embodiments without departing from the scope of the invention as broadly described. The described embodiments are, therefore, to be considered in all respects as illustrative and not restrictive.

The invention claimed is:

1. A preparation method, comprising:

housing a plurality of vials in a temperature-controlled environment, wherein the temperature-controlled environment is a lyophilization apparatus environment, wherein the plurality of vials each have a volume of a liquid substance therein and each defines an unfilled volume therein, each vial of the plurality of vials having a stopper partially inserted into an opening of each vial so that gas can transfer between the unfilled volume and an external volume, each said stopper comprising a disc-shaped top and one or more downward projections from said disc-shaped top forming one or more apertures by the partial insertion, the one or more apertures allowing for said gas transfer between the unfilled volume and the external volume;

at a temperature set-point greater than freezing, applying a vacuum to the environment to reduce pressure in the environment and in the unfilled volume of each vial to a first pressure level between 10 mbar and 500 mbar;

venting an insert gas into the environment to raise the pressure in the environment and in the unfilled volume of each vial to a second pressure level;

allowing the vials to rest in the environment at the second pressure level for a predetermined period;

repeating the applying, venting an allowing at least once; and fully inserting the stopper into each opening to seal each vial after the repeating;

wherein the substance in each vial after the inserting is still a liquid.

2. The method of claim 1, further comprising, prior to the fully inserting, once repeating only the applying and venting.

3. The method of claim 1, further comprising, after the fully inserting, capping each vial with a cap to retain the stopper in each vial.

4. The method of claim 1, wherein the temperature set-point is a first temperature set-point and the method further comprises, after the venting, controlling the temperature in the environment to be at a second temperature set-point that is different from the first temperature set-point.

5. The method of claim 4, wherein at least one of: the first temperature set-point is less than 10° C., and the second temperature set-point is between 17° C. and 26° C.

6. The method of claim 4 further comprising allowing the vials to rest in the environment for another predetermined period at the second temperature set-point.

7. The method of claim 6, wherein said another predetermined period is between 15 minutes and 60 minutes.

8. The method of claim 1, wherein the repeating comprises repeating the controlling.

9. The method of claim 1, wherein the temperature set-point is above a freezing temperature of the substance and wherein the first pressure level is greater than 10 mbar and less than 300 mbar.

10. The method of claim 1, wherein the second pressure level is between 800 mbar and 1000 mbar.

11. The method of claim 1, wherein the housing is performed at ambient pressure.

12. The method of claim 1, wherein the repeating of the applying, venting and allowing is performed at least twice.

13. The method of claim 12, wherein the repeating of the applying, venting and allowing is performed at least eight times.

14. The method of claim 1, wherein the repeating is performed a number of times effective to reduce a dissolved oxygen content of the substance to 0.4% or less.

15. The method of claim 1, wherein the repeating is performed a number of times effective to reduce an oxygen gas content in the unfilled volume to less than or equal to about one percent.

16. The method of claim 15, wherein the repeating is performed a number of times effective to reduce the oxygen gas content in the unfilled volume to between 0.01% and 0.6%.

17. The method of claim 1, wherein prior to the applying, the unfilled volume contains a substantially atmospheric level of oxygen gas and/or the substance contains a substantially atmospheric level of dissolved oxygen.

18. The method of claim 1, wherein the predetermined time period is between 15 minutes and 60 minutes.

19. The method of claim 1, wherein the substance in a liquid form comprises an oxygen-sensitive solution.

20. The method of claim 1, wherein the substance in a liquid form is an aqueous solution free of volatile constituents.

21. The method of claim 1, wherein the substance in a liquid form is stable at temperatures between 1° C. and 26° C. and pressures between 10 mbar and 1000 mbar.

22. A preparation method, comprising:

filling a plurality of vials with a predetermined volume of liquid so that an unfilled volume remains in each vial;

partially inserting a stopper into an opening of each vial so that gas can transfer between the unfilled volume of the vial and an external volume, each said stopper comprising a disc-shaped top and one or more downward projections from said disc-shaped top forming one or more apertures by the partial insertion into the vial opening, the one or more apertures allowing for said gas transfer between the unfilled volume of each vial and the external volume;

housing the vials in a temperature-controlled environment, wherein the temperature-controlled environment is a lyophilization apparatus; environment;

at a temperature set-point greater than freezing, applying a vacuum to the environment to reduce pressure in the environment and in the unfilled volume of each vial to a first pressure level between 10 mbar and 500 mbar;

venting an inert gas into the environment to raise the pressure in the environment and in the unfilled volume of each vial to a second pressure level;

allowing the vials to rest in the environment at the second pressure level for a predetermined period;

repeating the applying, venting and allowing at least once; and fully inserting the stopper into each opening to seal each vial after the repeating;

wherein the liquid in each vial after the inserting is still a liquid.

23. A preparation method, comprising:

filling a plurality of vials with a predetermined volume of liquid so that an unfilled volume remains in each vial;

partially inserting a stopper into an opening of each vial so that gas can transfer between the unfilled volume of the vial and an external volume, said stopper comprising a disc-shaped top and one or more downward projections from said disc-shaped top forming one or more apertures by the partial insertion, the one or more apertures allowing for said gas transfer;

housing the vials in an environment in which the temperature is fixed at a selected temperature, wherein the environment is a lyophilization apparatus; environment;

at a temperature set-point greater than freezing, applying a vacuum to the environment to reduce pressure in the environment and in the unfilled volume of each vial to a first pressure level between 10 mbar and 500 mbar;

venting an inert gas into the environment to raise the pressure in the environment and in the unfilled volume of each vial to a second pressure level;

allowing the vials to rest in the environment at the second pressure level for a predetermined period;

repeating the applying, venting and allowing at least once; and fully inserting the stopper into each opening to seal each vial after the repeating;

wherein the liquid in each vial after the inserting is still a liquid.

* * * * *